United States Patent [19]

Kalkbrenner

[11] 3,975,114

[45] Aug. 17, 1976

[54] SEAL ARRANGEMENT FOR TURBINE DIAPHRAGMS AND THE LIKE

[75] Inventor: Ralph W. Kalkbrenner, Hempfield Township, Pa.

[73] Assignee: Westinghouse Electric Corporation, Pittsburgh, Pa.

[22] Filed: Sept. 23, 1975

[21] Appl. No.: 615,853

[52] U.S. Cl. ..... 415/217; 415/138; 415/136; 277/26

[51] Int. Cl.[2] ..... F01D 5/20

[58] Field of Search ..... 277/26, 236; 415/136, 415/138, 172 A, 216, 217, 218

[56] References Cited

UNITED STATES PATENTS

| | | | |
|---|---|---|---|
| 1,857,961 | 5/1932 | Lamb | 277/26 |
| 3,146,992 | 9/1964 | Farrell | 277/26 |
| 3,393,894 | 7/1968 | Redsell | 415/217 |
| 3,519,366 | 7/1970 | Campbell | 415/138 |
| 3,542,483 | 11/1970 | Gagliardi | 415/217 |
| 3,728,041 | 4/1973 | Bertelson | 415/217 |
| 3,752,598 | 8/1973 | Bowers et al. | 415/173 R |
| 3,892,497 | 7/1975 | Gunderlock et al. | 415/217 |

*Primary Examiner*—Henry F. Raduazo
*Attorney, Agent, or Firm*—E. C. Arenz

[57] ABSTRACT

An arrangement for sealing the joints formed between the facing ends of turbine stator segments arranged in an annular array to form a turbine diaphragm is disclosed, the arrangement basically consisting of seal strips formed by at least two bimetal ribbons fastened along their longitudinal centerlines and adapted to deflect away from each other with increasing temperatures, the opposite edges of the strips being disposed in grooves in the facing ends of the stator segments.

5 Claims, 6 Drawing Figures

FIG.3
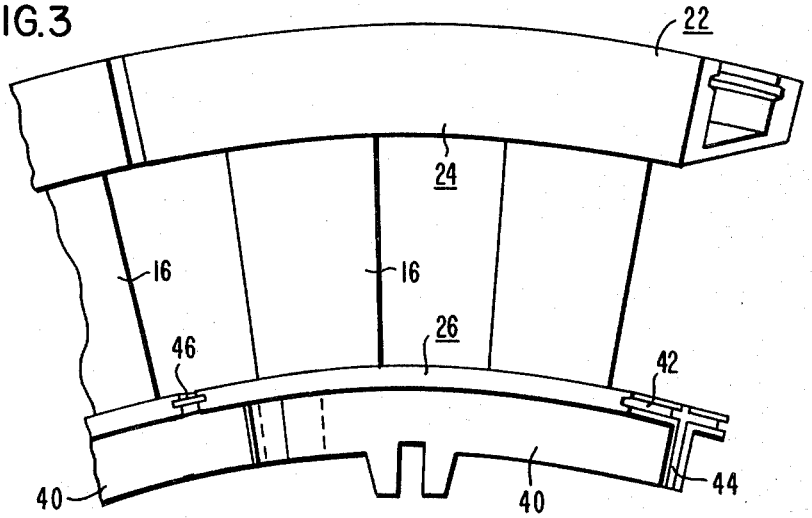
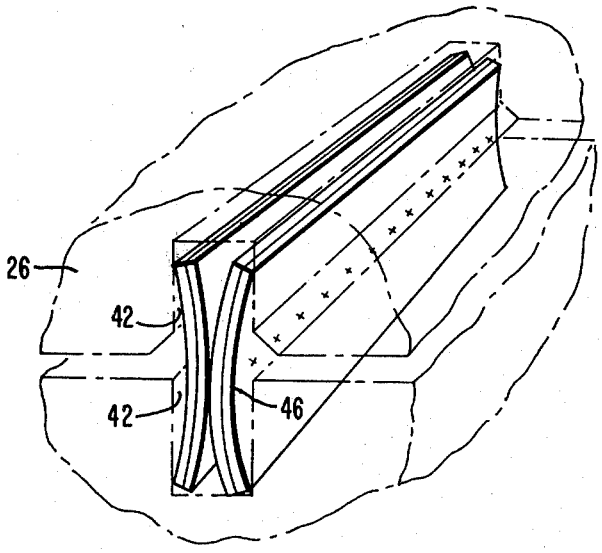
FIG.5
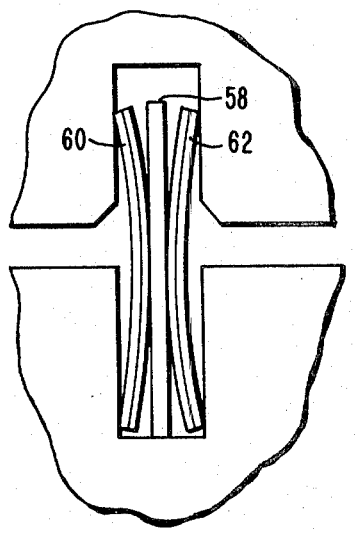
FIG.6

SEAL ARRANGEMENT FOR TURBINE DIAPHRAGMS AND THE LIKE

BACKGROUND OF THE INVENTION

1. Field of the Invention

The invention pertains to the art of sealing arrangements for sealing the ends of arcuate segments arranged in an annular array and located in an environment subject to substantial temperature changes. The invention may be particularly well employed in the art of gas turbine construction.

2. Description of the Prior Art

The advantage of minimizing leakage of cooling air flow from the diaphragm assemblies composed of a number of stator segments into the motive fluid path in a gas turbine is well known. Examples of patents dealing with sealing arrangements for such devices are U.S. Pat. Nos. 3,542,483 and 3,519,366, which teach arrangements of sealing strips provided to bridge the gaps between the opposing ends of adjacent stator segments. The sealing strips taught in these patents are single metal pieces which have their opposite longitudinal edge portions received in facing grooves provided in the opposing faces of adjacent stator segments. Such seal arrangements, while effective to a relatively high degree, do not provide as adequate a seal as is believed desirable. The problem arises from the requirements of machining and assembly tolerances which result in clearances through which cooling air can flow into the motive fluid path during operation of the turbine.

Therefore an aim of this invention is to provide an improved seal arrangement for the joints between the segments of a turbine diaphragm assembly.

SUMMARY OF THE INVENTION

In accordance with the invention, the sealing arrangement includes sealing strips formed by at least a pair of bimetal ribbons which are fastened along their longitudinal centerline portions and arranged with their high expansion sides facing so that the longitudinal edge portions of the ribbons will deflect away from each other with increasing temperatures. The longitudinal edge portions of the ribbons are received within the facing grooves provided in the ends of the stator segments.

DRAWING DESCRIPTION

FIG. 3 is an enlarged isometric view of one stator segment of the diaphragm and the end of an adjacent segment;

FIG. 5 is an isometric view of the seal strip of FIG. 4 as it appears in the operating environment with the wings deflected away from each other and sealing in the grooves in the ends of the stator segments illustrated in phantom; and FIG. 6 is a sectional view illustrating another form of seal strip according to the invention in its operating condition.

Figure 1:
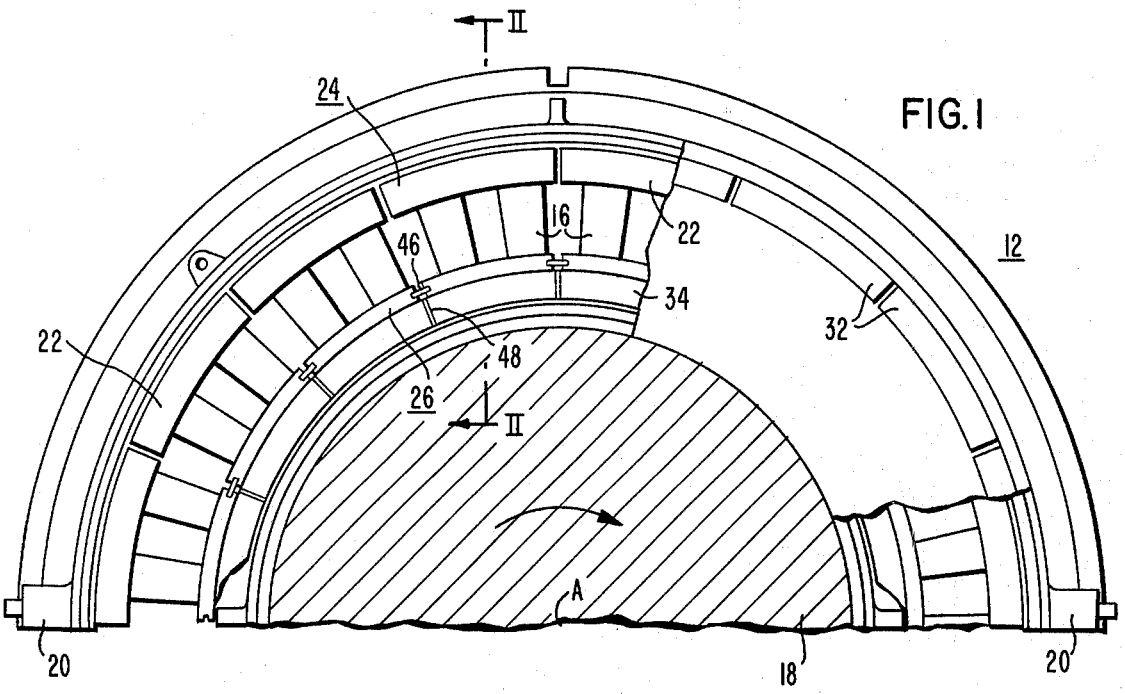
FIG. 1 is a view, partly in elevation and partly in section, of one-half of a turbine blade ring and diaphragm assembly incorporating the seal arrangement of the invention.
Figure 2:
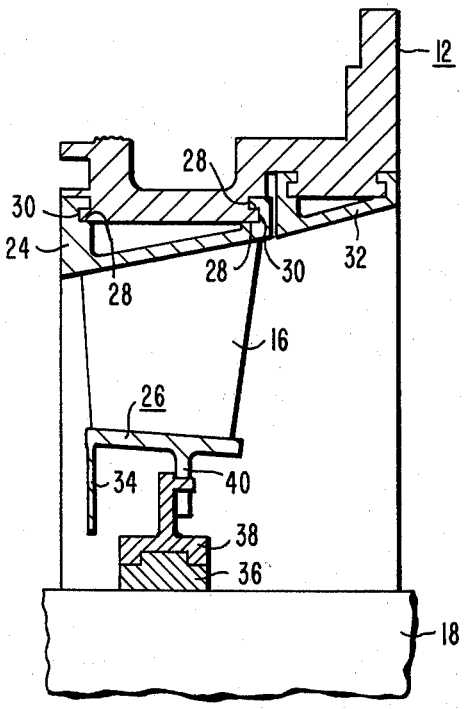
FIG. 2 is an enlarged view, in section, corresponding to one taken along the line II—II of FIG. 1.

The view of FIGS. 1–3 are basically the same as those in U.S. Pat. No. 3,519,366 since the views do not permit a showing of the details of the sealing strips. However, the description of the structure of the part of the gas turbine in which the invention may be employed is considered useful for a more thorough understanding of the invention. Referring particularly to FIGS. 1 and 2, the part of turbine shown therein includes a blade ring 12 supporting a diaphragm assembly 14 containing an annular array of vanes or blades 16 encircling a turbine rotor 18 which rotates about the central axis A of the turbine. In the typical multi-stage turbine, a stationary diaphragm assembly containing stationary blades is provided between the rows of rotor blades which rotate with the rotor. The stationary blades of the diaphragm direct the flow of motive fluid into the rotor blades (not shown), to rotate the rotor in a manner well known in the art. While the blade ring 12 is usually divided into two semi-circular halves, only the upper half is shown in FIG. 1, with the lower half being similar in structure to the upper half. These two halves are secured together by any suitable means such as bolts (not shown) adapted to extend through projections 20 and threaded into corresponding projections on the lower half. The blade ring 12 is mounted inside a turbine casing or cylinder (not shown).

Referring to FIG. 1, the diaphragm assembly 14 is made up of a plurality of segments 22 disposed in closely spaced end-to-end relation to form an annular array. Each segment of the stator basically has an outer arcuate shroud part 24 and an inner arcuate shroud part 26 between which the blades 16 extend.

Referring to FIG. 2, the outer shroud parts 24 are generally channel-shaped in cross section with grooves 28 provided in opposite sides of the channel for receiving tongues 30 on the blade ring 12, thereby slidably attaching the outer shroud part to the blade ring. FIG. 2 also shows ring segments 32 which are similar in cross section to the outer shroud segments 24 and are attached to the blade ring 12 in a similar manner to form a ring encircling the rotor blades (not shown).

The inner shroud parts 26 have inwardly extending flanges 34 and radially inwardly extending ribs 40 on the radially inner face of the inner shroud part 26. Segmented arcuate seal members 36 which cooperate with the rotor to minimize leakage of the fluid around the turbine blades are carried by housing structures 38, which are in turn attached to the ribs 40.

The form of an end of a single stator segment 22 is best shown at the right-hand side of FIG. 3. As there shown, the inner shroud part 26 has an axially extending groove 42 and a radially extending groove 44 provided in those end edges. While the particular stator segment illustrated does not show similar grooves in the outer shroud part 24, since the segment belongs to a downstream stage, both axially extending and radially extending grooves may be provided in the channel-shape of stator segments for the upstream stages. The grooves are of course provided in both ends of the shroud parts so that as the stator segments are assembled to the blade ring an axially extending seal strip 46 is positioned in the axially extending grooves, and a radially extending seal strip 48 is provided in the radially extending grooves in the opposing faces of the stator segments.

In accordance with the seal arrangement according to the invention, a seal strip 46 (FIG. 4) is formed of two bimetal ribbons 50 and 52 in facing relation and fastened, such as by spot welding 54, along the longitudinal centerline portion of the ribbons. Each bimetal ribbon has its high expansion side facing the high expansion side of the other ribbon. With this arrangement, the two bimetal ribbons will dish away from each other with an increased temperature to take the form illustrated in FIG. 5 in which the sealing strip 46 is shown located in the axially extending grooves 42 of the ends of the inner shroud parts 26 of two segments.

Each bimetal ribbon is formed of a low expansion alloy and a high expansion alloy which are selected in accordance with the proposed operating temperature of the turbine. The materials are selected so that the working stress at operating temperatures upon the bimetal deflecting into engagement with the walls of the grooves is kept within allowable limits.

Under some conditions it may be desirable to have an increased width weld band near the ends of the seal strip to restrain deflection in these areas to prevent a "dog-ear" deflection at the end corners. To this end, the weld band may be increased in width by additional spot welds such as indicated at 56 in FIG. 4.

Figure 4:
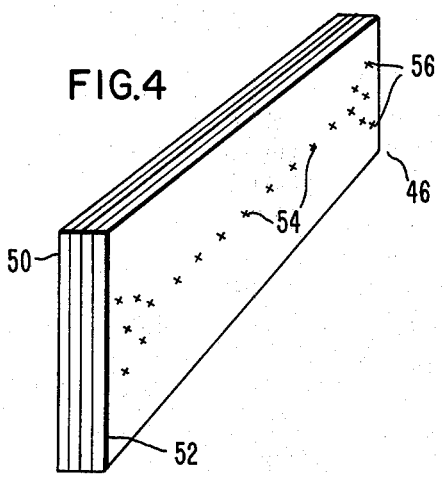
FIG. 4 is a perspective view of one form of seal strip according to the invention.

Another form which the seal strip may take is illustrated in FIG. 6 in which a single metal ribbon 58 is sandwiched between two bimetal ribbons 60 and 62 which are thinner than the ribbons 50 and 52 of FIG. 4. The use of the single metal interior ribbon 58 permits the use of thinner bimetals which may be desirable since that the flexivity of thermostatic bimetals intended for operating temperatures in excess of 1000°F. (538°C.) or above is less than for those which are to operate at lower temperatures, and therefore requires that in accordance with the deflection formulas that the thickness be reduced.

Among the advantages of the seal arrangement according to the invention are that tolerances and clearances for the cooperating parts of the seal arrangement may be reduced since the strip is assembled to the segments in its flat form making the assembly easier and then of course deflects to close the gaps provided with the greater clearances during the operation of the turbine. The disassembly which occurs periodically for servicing is also eased because it occurs with the seal strips in their flat condition and with greater clearances available.

The particular compositions of bimetals used at the various seal locations are selected in accordance with the differences in operating temperatures experienced at the locations where the seals are provided.

I claim:

1. In a gas turbine, a seal arrangement comprising:

a number of arcuate stator segments disposed in end-to-end relation to form at least a part of an annular array, the opposing ends of adjacent segments including facing grooves adapted to receive seal strips to bridge any gap existing between said ends; and seal strips received in said facing grooves, each of said seal strips comprising at least two bimetal ribbons fastened along their longitudinal centerline portions and arranged with their high expansion sides facing so that the longitudinal edge portions of said ribbons deflect away from each other with increasing temperatures.

2. In a turbine according to claim 1 wherein:

said seal strips each include an intermediate single metal ribbon sandwiched between said two bimetal ribbons.

3. An arrangement for sealing between the ends of segments having generally arcuate shapes and arranged in end-to-end relation to form an annular array located in an environment subject to substantial temperature changes, a sealing arrangement comprising:

means at the ends of said segments defining grooves located in facing relation to each other across the gap between the facing ends of the neighboring segments; and seal strips in said grooves and extending across the gap, each of said seal strips comprising at least two bimetal ribbons fastened along their longitudinal centerline portions and arranged to deflect away from each other with increasing temperatures.

4. An arrangement according to claim 3 wherein:

said seal strips each include an intermediate single metal ribbon sandwiched between said two bimetal ribbons.

5. In a gas turbine having a number of arcuate stator segments disposed in end-to-end relation to form at least a part of an annular array, the opposing ends of said segments having facing grooves to receive sealing strips, an improved sealing arrangement comprising:

at least two bimetal ribbons fastened together along their longitudinal centerline portions and arranged to deflect away from each other with increasing temperatures, said ribbons forming the sealing strips received by the grooves, each strip being disposed with the outwardly-deflecting longitudinal edge portions received in the facing grooves of the respective segments.

* * * * *